United States Patent [19]

Berman

[11] Patent Number: 5,035,422

[45] Date of Patent: Jul. 30, 1991

[54] INTERACTIVE GAME SHOW AND METHOD FOR ACHIEVING INTERACTIVE COMMUNICATION THEREWITH

[76] Inventor: Robert Berman, 16 Silvermine Woods, Wilton, Conn. 06897

[21] Appl. No.: 447,884

[22] Filed: Dec. 7, 1989

[51] Int. Cl.[5] ..... A63F 9/22

[52] U.S. Cl. ..... 273/439; 273/237; 273/269; 273/138 A; 273/144 R; 379/90

[58] Field of Search ..... 434/323; 379/91, 92, 379/90; 273/1 E, DIG. 28, 236, 237, 138 R, 138 A, 144 R, 144 A, 144 B, 269

[56] References Cited

U.S. PATENT DOCUMENTS

| | | | |
|---|---|---|---|
| 4,592,546 | 6/1986 | Fascenda et al. | 273/1 E |
| 4,649,563 | 3/1987 | Riskin | 379/88 |
| 4,655,461 | 4/1987 | Capri et al. | 273/144 A |
| 4,745,468 | 3/1988 | Von Kohorn | 434/323 |
| 4,817,129 | 3/1989 | Riskin | 379/88 |
| 4,845,739 | 7/1989 | Katz | 379/93 |
| 4,876,592 | 10/1989 | Von Kohorn | 434/323 |
| 4,884,818 | 12/1989 | Fogarty | 273/144 A |
| 4,922,522 | 5/1990 | Scanlon | 273/138 A |

*Primary Examiner*—Edward M. Coven
*Assistant Examiner*—Jessica J. Harrison
*Attorney, Agent, or Firm*—Melvin I. Stoltz

[57] ABSTRACT

By providing an interactive communication system whereby individuals are able to electronically select at least one possible outcome of a plurality of outcomes of a future event, individuals are able to participate in the outcome of that event and possible share in a prize award associated with the event. In the preferred embodiment, individualys forming the home audience of a televised game show are able to electronically communicate a series of random numbers using their telephones to participate in possible winning the prize awards of the show. In addition, both on-camera game participants and the studio audience also participate and have the abililty to win prizes.

15 Claims, 1 Drawing Sheet

INTERACTIVE GAME SHOW AND METHOD FOR ACHIEVING INTERACTIVE COMMUNICATION THEREWITH

TECHNICAL FIELD

This invention relates to game shows particularly suited for television and, more particularly, to television game shows wherein both the studio audience and the home viewing audience are able to actively participate in the game show with the ability to win prize awards.

BACKGROUND ART

Throughout the years of television broadcasting, game shows have been popular programs employed by all of the competing stations and networks in order to attract viewers. Many of these game shows have become very popular with the viewing audience and have enjoyed many years of continuous, regular broadcasting.

Over the years, many new game shows have been created in an attempt to achieve the level of success that has been attained by popular shows. In order to entice and maintain a large audience base, the new shows have employed a wide variety of formats and themes. However, in spite of the extraordinary effort that has been expended in developing new popular game shows and game show formats, no program has been able to attain a high level of direct, real interaction between the game show itself and the home viewing audience.

In particular, viewers are only able to participate in the game show action amongst themselves, without being able to share in the prize awards given to the on-camera participants. As a result, viewers have become bored and ultimately stop watching these shows.

In addition to the prior art failure to directly involve the home viewing audience in immediate, timely, interactive participation in the game show itself, prior art systems and game shows have also failed to achieve a format wherein the home audience is able to share in a prize award in a manner which is convenient and completely uncontrolled by the producers of the game show. In general, any prior art attempts to involve the home viewing audience have required the home viewers to mail in postcards which are then randomly selected to potentially allow one individual to win a prize award.

Such participation has failed to capture the interest of most viewers, since the selection of any home viewer participant is completely at the control of the game show producers. In addition, the selection of one participant from the vast number of submissions received makes the likelihood of being selected extremely remote.

In addition to these prior art game show failures with the home viewer, prior art game shows have also failed to directly involve the studio audience in a manner which would allow the studio audience, in its entirety, to actively participate in the game show by having an equal chance of winning prize awards. At best, prior art game shows have selected participants from the audience, who become the on-camera game participants. However, once the participants have been selected, the remaining studio audience become observers and are unable to participate in winning any prize awards.

Therefore, it is a principal object of the present invention to provide a game show system which allows home viewers to actively participate in predicting a future outcome of a game show and sharing a prize award, if correct.

Another object of the present invention is to provide a game show system having the characteristic features described above wherein on-camera participants, the studio audience, and the home viewing audience all participate in pre-selecting potential winning outcomes, with any individual properly predicting the winning outcome being awarded a prize.

Another object of the present invention is to provide a game show system having the characteristic features described above wherein the home audience is capable of directly, interactively participating in the actual game, thereby enhancing audience interest and excitement.

Another object of the present invention is to provide a game show system having the characteristic features described above wherein the future, prize-determining event is completely random and is out of the control of the game show producers.

A further object of the present invention is to provide an interactive communication system whereby individuals are able to independently select at least one possible outcome of a future event and participate in winning a prize award if their prediction is accurate by employing electronic communication, without leaving their home.

Another object of the present invention is to provide a game show system having the characteristic features described above which employs the interactive communication system described above to allow home viewers to participate in the televised game using their own home telephones.

Other and more specific objects will in part be obvious and will in part appear hereinafter.

SUMMARY OF THE INVENTION

The present invention completely eliminates the prior art drawbacks and difficulties by providing a new, unique game show system which enables on-camera game participants to win prizes, while also enabling active participation by both the studio audience and the home viewing audience. In the preferred embodiment, the game is based upon the selection of a set of numbers which are randomly picked from a pool of fixed numbers, similar to the arrangement employed in state-run lottery games. Due to the completely random, uncontrolled manner in which a prize winning number set is obtained, total confidence in the uncontrolled nature of the game prize award is achieved.

In the present invention, three levels of participation are provided. First, on-camera game contestants compete with each other to earn the particular numbers each contestant desires to form their personal number set. Preferably, prizes are also able to be won by the contestants during this active competition.

Second, the live audience is allowed to participate by completing a game card on which each individual provides his personal selection for the final winning set of numbers. Any participant correctly predicting the game show's final set of numbers will be awarded a pre-determined prize or share in the pre-determined jackpot.

Finally, the home viewing audience is also able to actively participate and share in the prizes being awarded. In the preferred embodiment, the home viewers participate by using their telephones to call a pre-advertised number. Once connected, the viewer transmits to the receiving station that individual's personal selection for the winning set of numbers. Any viewer who correctly predicts the final number set receives or shares the prize award.

In order to provide both efficient and timely receipt and recording of home audience participants and their number set selections, pre-registration of participants is preferred. In this way, each participant will receive instructions for playing the game as well as receiving a unique identifying code which will be easily recognized by the receiving station as indicating that particular person. Once identified, the caller transmits his particular number set selection and is automatically entered into the contest.

In the preferred embodiment, the home audience participation is achieved completely electronically, with the participant using a digital or tone-generating key pad. In this way, speed and accuracy are optimized. Preferably, the home participant will call the pre-advertised number and transmit his personal identification code upon hearing the requisite signal. Then, once notified by the receiving station that his code has been received and recognized, the caller activates the telephone keypad to transmit his selection for a winning number set. A call complete signal is then generated and the call is terminated.

Although any desired arrangement can be made for enabling a home viewer to call the receiving station, the preferred embodiment employs a "900" number. In this way, both the cost of the call and the expense of operating the system can be distributed over the price charged for calling the receiving station. In addition, this method also eliminates crank callers or constant repeat callers who could otherwise tie up the receiving station's ability to efficiently process the maximum number of calls.

Furthermore, the interactive communication system of this invention is also employable for enabling individuals to actively participate in any future event having multiple possible outcomes by attempting to predict, in advance, one specific outcome. In this way, individuals can enter any lottery of any state or wager on sport events, such as horse racing, wherever such wagering is legal.

The invention accordingly comprises the several steps and relation of one or more such steps with respect to each of the others, with this system embodying features of construction, combination of elements and arrangement of parts which are adapted to effectuate such steps and interact therewith, all as exemplified in the following detailed disclosure, and the scope of the invention will be indicated in the claims.

THE DRAWINGS

For a fuller understanding of the nature and objects of the invention, reference should be had to the following detailed description taken in connection with the accompanying drawings in which:

FIG. 1 is a schematic view showing the game board for use in the interactive game show of the present invention; and FIG. 2 is a diagrammatic view showing the interactive communication system employed by the home audience for interactively participating in the game show or any other event.

DETAILED DESCRIPTION

In the interactive game show system of the present invention, three separate and distinct levels or types of active participation are provided. In particular, the conventional, limited group of on-camera participants are provided. However, in addition, all studio audience members and all home viewers are able to actively participate in the game and be eligible to win prize awards. Furthermore, as is detailed herein, the interactive communication system of this invention, which enables the home audience participation, is also usable to allow individuals to actively participate in any future, uncontrolled event having a plurality of alternate outcomes.

Dealing first with the game show system of the present invention, a plurality of contestants compete with each other before a live studio audience in order to win money and prizes. In this invention, the game show is based upon the random selection of a set of numbers from a substantially larger number pool, in the manner similar to conventional lottery games. Although the number pool may comprise any desired quantity of numbers, it has been found that a number pool of 54 numbers, with each being sequentially arranged, provides a preferred number pool.

Figure 1:
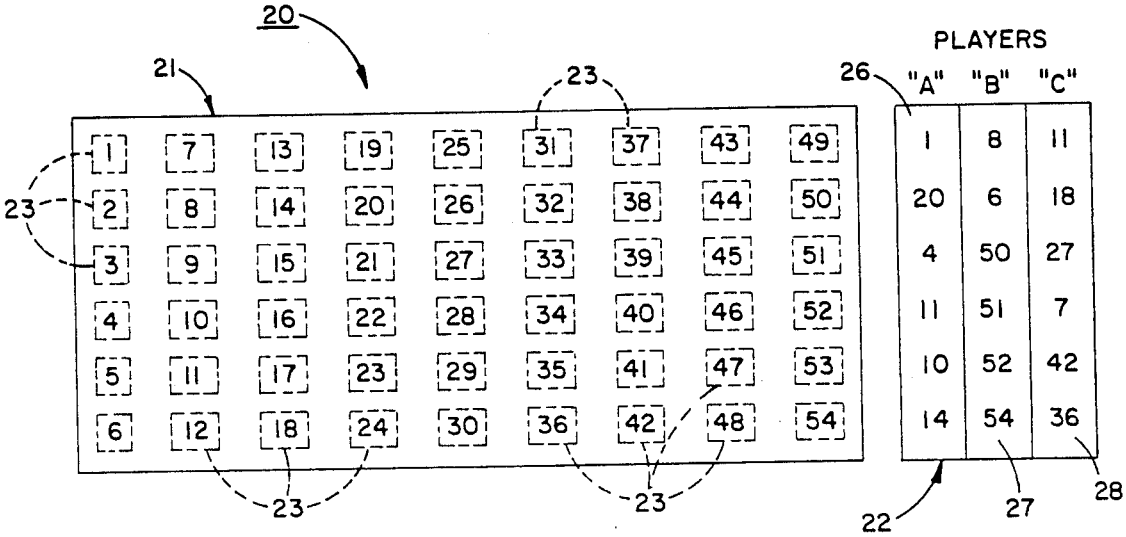

In FIG. 1, the preferred embodiment of game board 20 is shown. In this embodiment, game board 20 incorporates a first display panel 21 wherein the entire number pool is shown. As depicted in FIG. 1, display panel 21 of game board 20 incorporates 54 independent zones 23, each of which displays a unique number. In addition, a second display panel 22 is also provided wherein the number set selected by each contestant is clearly provided.

In the preferred embodiment, three on-camera contestants compete with each other by answering questions as they attempt to earn the particular set of numbers which the player hopes will be the final, randomly-generated, grand prize winning number set. Preferably, six independent numbers represent the number set and each player attempts to select a number set which will correspond to the game show generated number set.

During the competition phase of the game, which is more fully described below, each contestant, in a predetermined rotation, selects one number which that contestant wishes to become a part of his personal set of numbers.

As shown in FIG. 1, display panel 22 of game board 20 comprises player zone 26 in which the numbers earned by contestant "A" are displayed, while player zone 27 displays the numbers of contestant "B", and player zone 28 displays the numbers earned by the contestant "C". Although it has been found that employing three on-camera contestants, with each selecting a number set of six independent numbers is preferred, any other variation can be employed without departing from the scope of the present invention.

In order for each player to earn a desired number and have that number placed in that contestant's player zone as one of his number set, a player picks the number from display panel 21, and is required to answer the question hidden in zone 23 behind that particular number. If the player correctly answers the question, that number is then illuminated in the appropriate player zone of display panel 22. For example, if contestant "A" selects the numeral "1", a question will be displayed in zone 23 behind numeral "1". Once this question is properly answered by contestant "A", the numeral "1" will be displayed in player zone 26, as shown in FIG. 1.

In order to enable each player to earn prize awards during this active competition phase of the game show of the present invention, each of the numerals in display panel 21 of game board 20 would also have a particular prize award associated therewith, with the prize being displayed before the question is revealed.

In the preferred embodiment, dollar values ranging between about $100 and $1000 are employed as the prizes. In this way, when contestant "A" selects numeral "1" for adding the numeral "1" to that player's number set, display zone 23 would first show a dollar value which contestant "A" will earn if the question is properly answered.

In order to allow the contestants to select identical numbers, if so desired, all questions are changed after the question has been properly answered by a previous player. In this way, each contestant will have the ability to select any desired numeral, even if that numeral has been previously selected by another contestant.

If desired, questions can be changed each time a question is displayed, even if that question is not correctly answered. Alternatively, if a previous contestant fails to properly answer a question, it may be desirable to keep the question available for a subsequent contestant to select that number, in order to earn the prize money associated therewith if that contestant believes he knows the correct answer.

In order to further heighten interest in the game and allow each contestant to generate substantial prize money during the competition portion of the game, the preferred embodiment of the game employs a prize multiplier each time a contestant successfully answers a question. In one embodiment, the prize multiplier advances and increases with the player's success, with either the prize money for that question or the player's total earnings doubling when the player successfully answers his second question, and tripling when the player answers his third question. Preferably, this pattern continues throughout the competition phase, so that in the last round, the prize money for each question or each player's prize earnings are multiplied by six when the player successfully answers his sixth and final question.

Alternatively, prize multipliers can be hidden throughout the game board, in association with some or all questions, and revealed after a contestant selects a desired number. In this embodiment, the entire accumulated earnings of the player would be multiplied by the multiplying factor displayed or, alternatively, the particular dollar value hidden behind the multiplier is multiplied by that factor. In this way, additional excitement and interest can be generated, particularly by employing multipliers ranging between two and twenty-five. Depending upon the number of multipliers employed and the value of the multiplier factor, either the question value or the entire player's accumulated prize money can be selected for such prize multiplication increase.

Once one or more contestants have answered six questions correctly and have established their desired number set, the final, grand prize winning number set is generated. In the preferred embodiment, if two or more contestants have each correctly answered six questions and have complete number sets, the player having accumulated the most prize money is selected to participate in the final, grand prize number set selection.

In addition, the grand prize number set employed for determining whether or not the participating contestant succeeds in winning the grand prize is also employed as the number set upon which the home viewing audience and the studio audience winners are determined. In this way, excitement and interest in the entire show is enhanced. Furthermore, in order to maximize excitement and interest, separate prize pools are established for the home audience winners and the studio audience, in addition to the on-camera contestants' prize pool.

In the preferred embodiment, the grand prize winning number set is selected using random number generating equipment similar to the equipment employed in selecting winning lottery numbers. Typically, these winning numbers are obtained by having a set of identical balls with each having a unique number printed thereon, and placing the balls in a single container, with the container being rotated for mixing. Then, the equipment randomly selects a single ball, typically by vacuum, drawing the various numbered balls to the top of the container for identification and recording. In this way, the first six numbers drawn from the pool of numbers represents the winning number set which forms the basis for all prize awards for the particular day's version of the game show.

In view of the statistical probability that the winning on-camera contestant will have selected a number set which is not identical to the number set generated during the grand prize number selection, the game show of the present invention comprises a procedure for enabling the otherwise winning contestant to also win the grand prize award. Depending upon the particular system desired, this procedure can be accomplished in various equally efficacious ways.

In one embodiment, the on-camera contestant is required to answer six additional questions, each of which are hidden behind the six winning numbers generated during the grand prize number selection. If all six questions are correctly answered, the on-camera contestant is the grand prize winner and is awarded the previously stated high value grand prize award.

In an alternate embodiment, the on-camera contestant is required to answer only the questions behind those numbers which are not found in the set of numbers that contestant has earned during the game. In this way, each identical number in the contestant's number set which corresponds to an identical number in the grand prize winning number set, the player is automatically credited with having established that number, and needs only to answer the questions hidden behind the numerals appearing in the winning number set which are not present in the contestant's number set. In this way, a winning contestant may have to answer as few as one question or as many as six questions. If and when the required number of questions has been correctly answered, that contestant is the winner of the grand prize award.

In regard to the active participation of the studio audience, each studio audience member is allowed to complete an entry card which is collected prior to the start of the game show or, at least, prior to the selection of the grand prize winning number set. Each card submitted by a studio audience member will have indicia identifying the audience member as well as that individual's selection for the winning number set.

If the grand prize number set generated at the end of the game show corresponds identically to the number set submitted by one or more studio audience member, that audience member wins the predetermined audience prize award. Depending upon the value of the prize award, identical prize awards can be given to each successful audience member or can be shared by the plurality of audience members, if any, having selected the identical number set.

In order to enable home viewers to interactively participate in the televised game show, an interactive communication system has been developed which allows each home viewer to use a conventional telephone to identify himself and the particular six numbers representing that individual's personal selection for his number set. Each home participant would identify himself, using a unique code or numeral sequence, such as the individual's social security number.

In this way, the receiving station would obtain a specific individual identifier, as well as a particular six number set for each participant. In addition, each participant independently selects a personal desired winning number set with full confidence that the game show producers are incapable of controlling the outcome of the randomly generated grand prize winning number set, which is obtained using well-known conventional equipment. In order to further assure the honesty of the selections of a winning number completely at random, the equipment and selection process can be monitored by independent agencies.

In order to defray the expense of the central processing equipment and prevent individuals from purposefully flooding telephone lines to prevent other participants from entering the contest, the preferred embodiment of the present invention employs a "900" number for the telephone number participants to call in order to enter the game show contest. In this way, using standard practice, each individual making a telephone call to participate in the game show prize award would bear a pre-determined and pre-advertised expense, a part of which would be paid to the game show producers.

Furthermore, if desired, pre-registration of contestants can be employed in order to expedite the identification process and provide each caller with a clear set of rules and preferred timing for receipt of phone calls. The registration process, if employed, also enables a potential contestant to request an identification number, which would be provided by the game show producers. In addition to providing a unique, easily generated identifying indicia, which the user would employ in all telephone calls, the available telephone numbers and operational times would also be provided to the home viewer.

As is typical with most game shows, some, if not all, of the home viewers receive the televised broadcast on a taped delay. As a result, each participant must be aware of the taping schedule employed by the game show producers, so that their entry into each desired game show performance can be properly effectuated. As a result, by having a pre-registration process, both the individual identifying indicia can provided and a complete schedule to assure that any individual can actively participate in the game show whenever desired.

Of course, if the game show is to be televised as a live performance in any particular location, this information would also be provided to the home viewer, so that the preferred timing schedule for assuring that individual's entry into the contest can be effectuated in an orderly manner, thereby assuring that all desired entries are received and efficiently processed.

Figure 2:
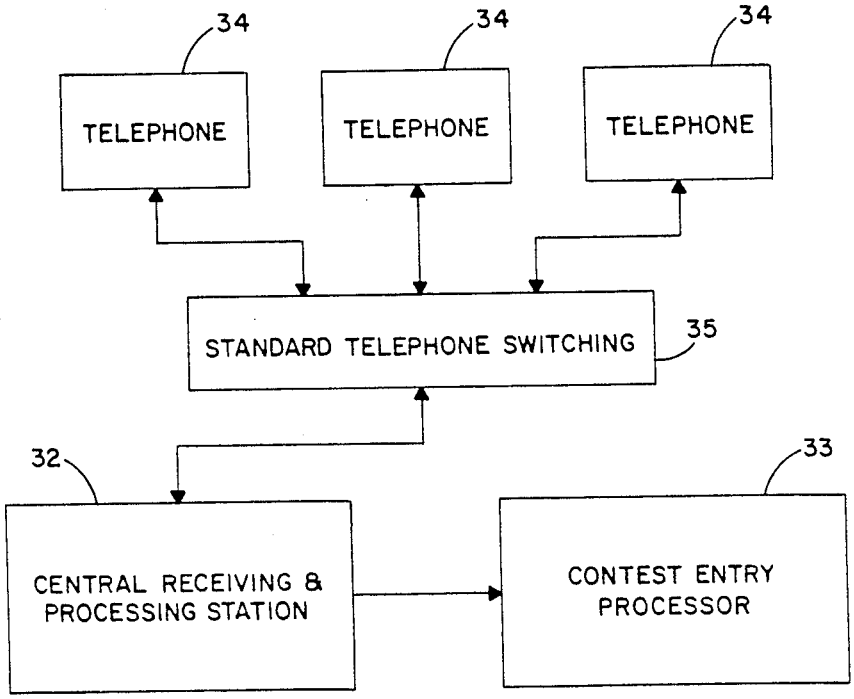

In FIG. 2, the preferred embodiment for the interactive communication system of the present invention is detailed. As shown therein, interactive communication system 30 comprises a central receiving and processing station 32 which communicates directly with a contest entry processor 33. In this way, the contestant identification indicia and the unique number set for each contestant is received and recorded by processing station 32. At the appropriate, desired time, all of the information received by central processing station 32 is transmitted to contest entry processor 33, in order to allow all of the telephone callers to be officially entered into the contest. Once received, contest entry processor 33 stores the information received and, subsequently, compares the final randomly generated grand prize winning number set of that particular performance of the game show with the number sets entered by the telephone callers for this particular show.

Contest entry processor 33 determines each and every winning contestant who has selected a number set identical to the grand prize winning number set and provides the information to the show producers. Preferably, the existence of a winner and the identity of that winner is provided to the viewing audience as part of the televised show, thereby adding to the excitement and interest in the show.

If desired, the function provided by contest entry processor 33 can be incorporated into control receiving and processing station 32. In this embodiment, the winners are determined by processing station 32 and the game show producers informed, at the end of the comparative analysis, the identify of any winners.

In the preferred embodiment, each individual home contestant desiring to participate in winning a prize award would employ a telephone 34 in order to enter the game contest. As depicted in FIG. 2, a plurality of telephones 34 are connected to standard telephone switching equipment 35, with switching equipment 35 being connected to the central receiving processing station 32. In this way, each home contestant is able to transmit the desired information to central receiving and processing station 32.

In the preferred embodiment, as mentioned above, home contestants employ a "900" telephone number in order to connect the home contestant with central receiving and processing station 32. In addition to efficiently achieving the interconnection of the individual with central receiving and processing station 32, standard telephone switching equipment 35 also records and bills the caller for a predetermined fee. A portion of this fee is provided by the telephone company to the game show producers. In this way, the expense of the development and operation of the processing equipment is partially absorbed by the contest entrants.

In addition, by requiring each contestant to pay a predetermined minimum entry fee as a telephone call expense, the game show producers are assured that crank callers are eliminated since, such crank callers will be required to pay for each telephone call made. Any individual desiring to enter a plurality of different number sets is able to do so, but is required to pay for each individual entry. Consequently, by charging each individual for entering the contest with a single number set, any abuse of the equipment by repeat callers is virtually eliminated.

By employing the interactive communication system of this invention, individuals are now able to actively participate in a televised game show in a manner which provides assurance and confidence that each individual has an equal chance of winning prize awards and that the outcome upon which the award is based is completely outside of the control of the game show producers.

In addition to establishing an interactive communication system which allows home contestants to actively participate in a televised game show, with confidence and assurance that the producers are incapable of controlling the final outcome which determines the prize award winners, the interactive communication system of this invention is also employable in a plurality of alternate contest situations. By employing interactive communication system 30, a home contestant can enter any desired lottery in any desired state, or wager on the future outcome of any sporting event, such as horse racing, boxing, football, etc. Of course, any such sport event wagering would only be effectuated in areas where such wagering is legal.

In order to enable a home contestant to enter any desired future contest having a plurality of outcomes, central receiving and processing station 32 is programmed to receive identifying indicia designating the particular event in which the home participant seeks to participate, as well as billing information, such as a credit card number, so that any desired wager or lottery expense can be immediately and efficiently processed and collected. In addition, a contest entry processor 33 is also required to determine any winning entrants and provide the required notification to the contest sponsors or agent for paying winners.

By employing the interactive communication system defined and described herein, individuals are able to participate in any desired future contest or event in the hope of properly selecting one of the plurality of outcomes of the event and winning the prize award associated with an accurate prediction. In addition, by employing the system of this invention, speed and efficiency are provided and individuals are now able to participate in events, where such participation was either difficult or impossible.

It will thus be seen that the objects set forth above, among those made apparent from the preceding description, are efficiently attained and, since certain changes may be made in carrying out the above process or in the construction set forth above, without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statement of the scope of the invention which, as a matter of language, might be said to fall therebetween.

Having described my invention, what I claim as new and desire to secure by Letters Patent is:

1. A method for providing a televisable game show in which the home viewing audience and the studio audience are able to directly participate by having a chance to win prize awards comprising the steps of:

A. selecting at least two contestants;

B. establishing a pool comprising a fixed quantity of unique indicia;

C. requiring one contestant to select and earn the right to have one of the indicia in the pool, placed in that contestant's personal indicia set, said indicia set comprising a fixed number of available spaces, said fixed number being substantially smaller than the total number of available indicia;

D. requiring each other contestant to individually select and earn the right to have one indicia from the pool placed in that contestant's personal indicia set;

E. repeating the indicia selection and earning steps for a pre-determined time period or until the contestants have filled the spaces available in their personal indicia set;

F. randomly selecting a game winning indicia set from the entire pool of indicia, said game winning indicia set having the same number of indicia as the personal indicia set of each contestant; and G. awarding a grand prize to a participating contestant having a personal indicia set which matches in its entirety the randomly generated, game winning indicia set.

2. The method defined in claim 1, wherein the indicia are further defined as comprising unique numbers and the pool of unique numbers is further defined as comprising a total of between about thirty-six and sixty.

3. The method defined in claim 2, wherein said personal indicia set is further defined as ranging between about four and ten.

4. The method defined in claim 1, wherein each contestant earns the right to have the indicia selected from the pool and placed in that contestant's personal indicia set by correctly answering a question associated with that indicia.

5. The method defined in claim 4, comprising the additional steps of

H. establishing a highly visible, game board displaying the entire pool of indicia; and I. associating a question with each indicia which question must be correctly answered by a contestant before the contestant selecting that indicia is able to have that indicia placed in that contestant's personal indicia set.

6. The method defined in claim 5, comprising the additional step of

J. associating a prize award with each indicia, which prize award is won by the contestant selecting the indicia and properly answering the question also associated therewith.

7. The method defined in claim 6, wherein said prize award is further defined as comprising a cash award.

8. The method defined in claim 7, comprising the additional step of

K. associating a multiplication factor with a plurality of the indicia, said multiplication factor being revealed upon the selection of the indicia by a contestant, whereby the cash prize award associated with that indicia is multiplied by the multiplication factor and awarded to the contestant successfully answering the question associated therewith.

9. The method defined in claim 8, wherein said multiplication factor ranges between about two and twenty-five.

10. The method defined in claim 9, comprising the additional step of

L. selecting for participation in winning the grand prize the contestant having earned the most prize money during the process of obtaining a personal indicia set.

11. The method defined in claim 1, comprising the additional step of

H. awarding the grand prize to the participating contestant who fails to have a personal indicia set perfectly matching the randomly generated indicia set, provided such contestant correctly answers the grand prize winning questions associated with the indicia appearing in the grand prize indicia set and not present in the contestant's personal indicia set.

12. The televisable game show method defined in claim 1, comprising the additional steps of H. providing each member of the studio audience with a game card for designating a personal indicia set, I. receiving and recording each studio audience selection for a personal indicia set; and J. awarding a pre-determined prize award to all studio members having submitted a personal indicia set which matches in its entirety the randomly generated game winning indicia set.

13. The televisable game show method defined in claim 1, comprising the additional steps of H. receiving and recording personal indicia set selections from home viewers;

I. comparing the personal indicia set submitted by each home viewer with the randomly generated, game winning indicia set; and J. awarding a pre-determined prize to all contestants having entered a personal indicia set which matches in its entirety the randomly generated, game winning indicia set.

14. The televisable game show method defined in claim 13, wherein said receiving and recording step is provided by computer means capable of receiving telephone calls from home viewers, thereby enabling the home viewers to actively participate in the game show by merely employing their telephones.

15. The televisable game show method defined in claim 14, wherein said computer means is further defined as comprising a. means for receiving individual identifying indicia via telephone transmission for identifying each individual caller, b. means for receiving and recording in association with each individual caller the particular contest-entering personal indicia set of the caller; and c. means for comparing the personal indicia set of each caller with the randomly generated, game-winning indicia set and identifying all individuals whose personal indicia matches in its entirety the randomly generated game winning indicia set.

* * * * *